US006726388B1

(12) United States Patent
Monahan

(10) Patent No.: US 6,726,388 B1
(45) Date of Patent: Apr. 27, 2004

(54) CLEANING AID ATTACHMENTS FOR A CLEANING IMPLEMENT

(76) Inventor: Patrick H. Monahan, 239 S. Pine St., Arcola, IL (US) 61910

( * ) Notice: Subject to any disclaimer, the term of this patent is extended or adjusted under 35 U.S.C. 154(b) by 0 days.

(21) Appl. No.: 10/319,047

(22) Filed: Dec. 13, 2002

(51) Int. Cl.[7] ..... A47L 1/08; B43K 29/00

(52) U.S. Cl. ..... 401/138; 401/195; 401/137; 401/18; 401/27; 401/39; 401/38

(58) Field of Search ..... 401/195, 137, 401/138, 139, 18, 27, 37, 38, 39; 15/228, 231, 246

(56) References Cited

U.S. PATENT DOCUMENTS

| | | | | | |
|---|---|---|---|---|---|
| 3,457,016 | A | | 7/1969 | Gotberg | |
| 4,432,472 | A | * | 2/1984 | Lamm | 222/174 |
| 4,436,224 | A | * | 3/1984 | McInerny | 222/183 |
| 5,092,699 | A | | 3/1992 | Silvenis | |
| 5,364,198 | A | * | 11/1994 | Skenderi | 401/138 |
| 5,671,872 | A | * | 9/1997 | Daniels, Jr. | 222/192 |
| 5,819,989 | A | * | 10/1998 | Saraceni | 222/192 |
| 5,908,255 | A | * | 6/1999 | Branch | 401/139 |
| 6,138,874 | A | * | 10/2000 | Audrey | 222/192 |
| 6,216,920 | B1 | * | 4/2001 | Baggett | 222/192 |
| 6,394,683 | B1 | | 5/2002 | Pao | |

FOREIGN PATENT DOCUMENTS

WO PCT/ES01/00065 2/2001

* cited by examiner

*Primary Examiner*—David J. Walczak
(74) *Attorney, Agent, or Firm*—R. William Graham

(57) ABSTRACT

A cleaning aid attachment is configured for connection to a handle of a conventional cleaning implement and includes a removable hand held sprayer connected to a handle of a cleaning implement. A retainer connects to the handle of the cleaning implement for retaining a roll of paper towels having a tube therein, wherein the tube of the towels receives the handle and the retainer holds the towels in a predetermined position on the implement handle.

13 Claims, 2 Drawing Sheets

10
14
12
30
20
26
24
32
56
16
34
38
18
44
40
56
54
52
42
50
56
48
5

30
10
12
36

14
34
26
32
28
20
20
24
24

16
56
58
56
58

56
42
T
56

14
32
12
30
26
22
28

CLEANING AID ATTACHMENTS FOR A CLEANING IMPLEMENT

BACKGROUND OF THE INVENTION

This invention relates to the art of cleaning. More particularly, the invention relates to a spray device with ergonomic benefits and paper towel holder for attachment to a cleaning implement.

Conventionally, cleaning a floor requires a mop, bucket with cleaning solution therein, mop wringing and bucket carting. Recently, mops have been developed to dispense with the need of using a separate bucket of cleaning solution. One mop type includes a plurality of cloth cleaning strips wherein an outer strip can be peeled away after their cleaning usefulness has been achieved. This type of mop is often not as cost efficient and in situations which require use of additional cleaning solution on the floor and renders such use impractical. Another mop type has an integrally formed a cleaning solution container into the mop handle with a means for dispensing the solution on demand. The problem with this mop solution is that it is relatively costly and limited in method of application. One such mop requires a battery powered device to spray the cleaning solution and is relatively cost prohibitive. Another disadvantage of the prior designs is that they require a particular mop cleaning solution to operate effectively.

There remains a need to improve on existing cleaning technology, particularly the art of mops which do not require the use of a bucket of cleaning solution. The present invention overcomes the problems with the art and further provides an optimal solution for a cleaning implement providing economy in that can use various cleaning solutions, ergonomic design having more cleaning friction with less force, and versatility in that it can be used with a variety of current mop designs.

SUMMARY OF THE INVENTION

It is an object of the invention to provide an improved cleaning implement.

It is a further object of the invention to provide a floor cleaning implement which can be used without a separate bucket of cleaning solution.

It is a further and more particular object of the invention to provide a retrofit sprayer handle and bottle holder for connection to many conventional cleaning implement.

It is another object to ease cleaning through the use of the present invention.

It is another object to provide a paper towel holder on a cleaning implement.

Still another object is to provide a more ergonomic mop design.

These as well as other objects are accomplished by the sprayer device and paper towel holder of the present invention. The retrofit sprayer handle and bottle holder is configured for connection to a handle of a conventional cleaning implement.

The retrofit sprayer handle and bottle holder includes a spray handle having a first end configured to receive an end of the implement handle and has means for retaining the same thereto. A second end of the spray handle includes a spray nozzle. An intermediate section connects the first end and second end and enables an ergonomic hand grip to be made thereon.

The spray handle further includes a pump trigger operatively connected to the nozzle. A supply tube has a first end extending into the spray handle which operatively connects to the pump trigger to supply fluid to the nozzle. A second end of the tube extends outside the spray handle.

A threaded cap receives the second end of the tube therethrough, wherein the cap is configured to thread to a conventional cleaning fluid supply bottle with the second end of the supply tube extending sufficiently therethrough to extend into the bottle fluid when the cap is connected to the bottle. A bottle holder is provided which connects to the implement handle for holding the bottle.

In one case, the spray handle is readily removable from the implement handle to provide the use of the spray handle in a manner relatively free from the implement handle's first end. The bottle holder is removably fixable to provide quick attachment and detachment to different implements.

Supply tube clips are also provided on the implement handle for retaining the tube. Additionally, the tube when retained by the clips forms a paper towel retaining mechanism.

Other objects and advantages will be readily apparent to those skilled in the art upon viewing the drawings and reading the detailed description hereafter.

DETAILED DESCRIPTION

Figures 1A, 1B, 2, 3, 4, 5:
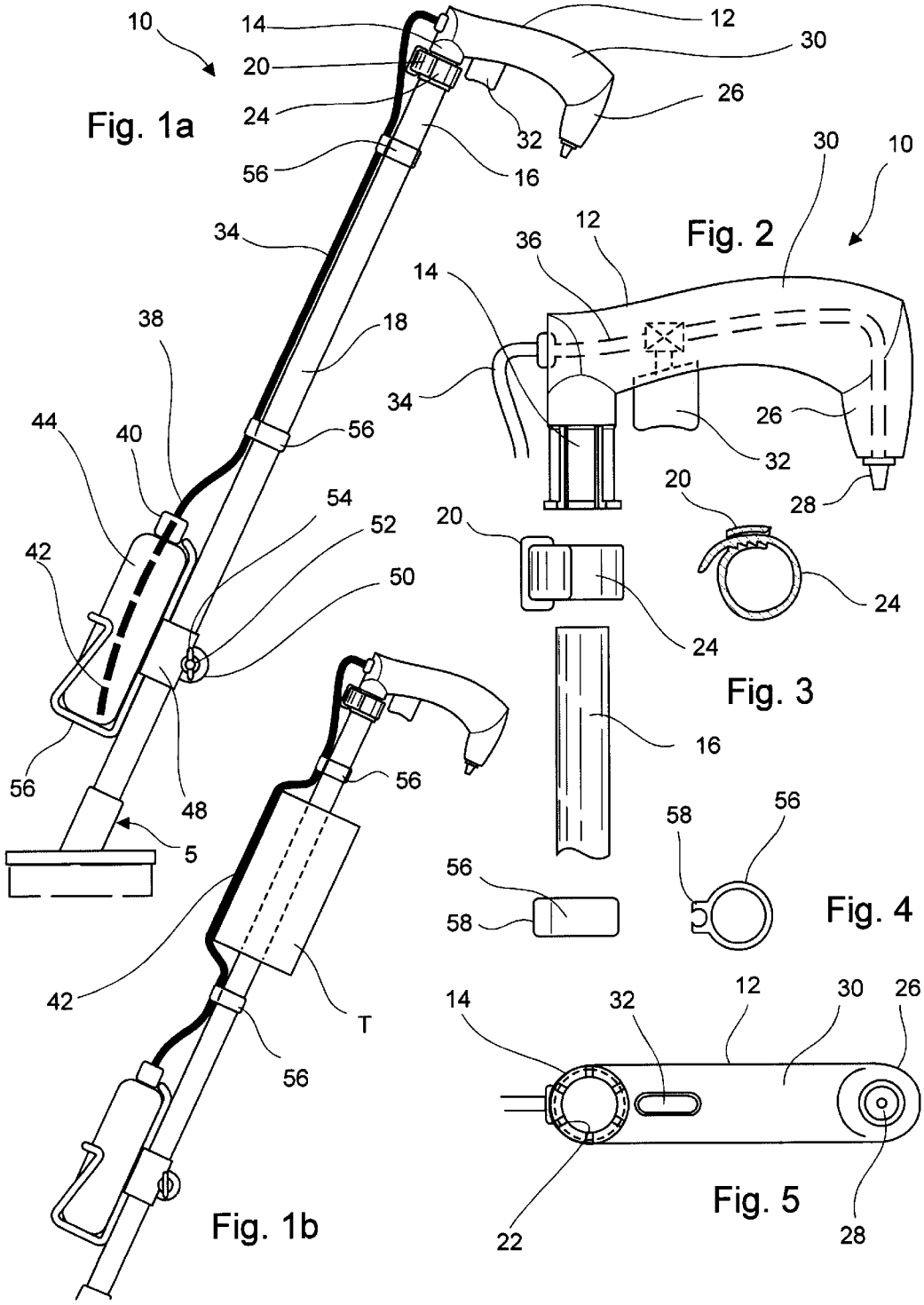
FIG. 1*a* is a perspective view of the invention in a mode of use.
FIG. 1*b* is a perspective view of another embodiment of the invention.
FIG. 2 is a partial assembly view of the invention of FIG. 1.
FIG. 3 is a side view of a connector used in the invention.
FIG. 4 is a side view of another connector used in the invention.
FIG. 5 is a bottom view of a spray handle of the invention.
Figure 1C:
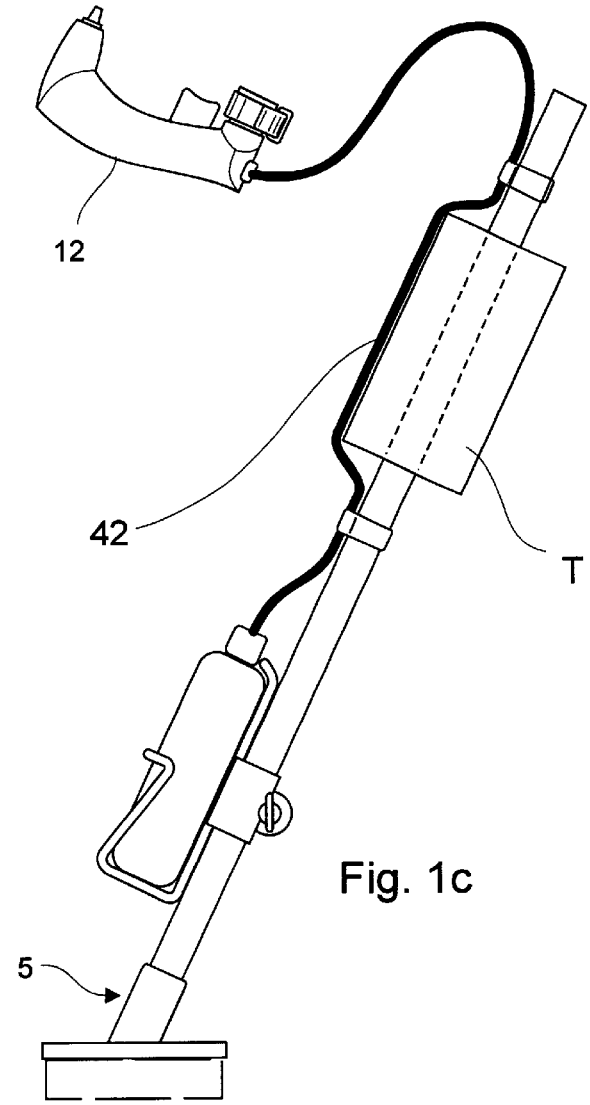
FIG. 1*c* is a perspective view of the invention in another mode of use.

Referring now to the drawings, the sprayer device and paper towel holder of present invention for a cleaning implement 5 is generally designated by the numeral 10. FIG. 1*a* illustrates retrofit sprayer handle 12 and bottle holder 46 in one mode of operation, while FIG. 1*c* depicts another mode of operation.

The sprayer device and paper towel holder 10 includes a sprayer handle 12 having a first end 14 having a collar configured to receive an end 16 of the implement handle 18 and has a connector 20 for retaining the same to the handle 18. The end 14 is shown in FIG. 5 to have an open sleeve surface 22 to receive the end 16. The connector 20 can include a ratchet clamp type mechanism 24 as seen in FIG. 3, for example. FIG. 1*a* depicts the sprayer handle 12 fixed to end 16 thus enabling the implement's handle 18 to be controlled through the spray handle 12. In FIG. 1*c*, the spray handle 12 is readily removably fixable to the implement handle 18 via clamp 24 to provide the use of the spray handle 24 in a manner relatively free from the implement handle's first end 16.

A second end 26 of the spray handle 12 includes a spray nozzle 28 which when the end 14 is connected to the handle 18 is generally directed to spray in a path adjacent the handle 18. It is contemplated that the spray nozzle 28 can be configured to spray in a desired predetermined path and pattern. An intermediate section 30 connects the end 14 and the end 26 and enables one's hand grip to be made thereon.

The spray handle 12 further includes a pump trigger 32 which is operatively connected to the nozzle 28. A supply tube 34 has an end 36 extending into the spray handle 14 which operatively connects to the pump trigger 32 to supply fluid to the nozzle 28. An end 38 of the tube 34 extends outside the spray handle 12 to a threaded cap 40.

The threaded cap 40 receives the end 38 of the tube 34 therethrough, wherein the cap 40 is configured to thread to a conventional cleaning fluid supply bottle 44 with the end 38 extending sufficiently into the bottle fluid to enable operation in a manner to draw fluid to the nozzle 28 as a function of actuation of the pump trigger 32.

A bottle holder 46 is provided which connects to the implement handle 18 for holding the bottle 44. The bottle holder 46 can be configured to receive a range of bottle sizes. Again, one means for quick and secure attachment. i.e., clamp 24, is shown, it is contemplated that other types of connections for the holder 46 can be employed to carry out the invention.

The bottle holder 46 is removably fixably to provide quick attachment and detachment to different implement handles. The bottle holder 46 can include, for example, a split sleeve 48 having one side connected to the holder 46 and another side having mating flange tabs 50 formed adjacent the split with aligning bores to receive bolts 52 and nuts 54 which enable connection to the implement handle. Optionally, a similar ratchet clamp can be used as depicted in FIG. 3.

FIG. 4 depicts a connector sleeve 56 configured to frictionally slidably receive the handle 18 and has a supply tube clip 58 formed thereon for retaining an intermediate section 42 of the supply tube 34. Again, the connector sleeve 56 can be alternatively formed in a manner as described to clamp the handle 18. Another feature of the present invention depicted in FIG. 1*b* is its provision for a self supporting paper towel holder through the use of the sleeves 56 and tube 34 which when connected to the clips 58 serve as a retainer for the paper towels T. The paper towels T include a conventional inner tube which receives the handle 18 therethrough and the sleeves 56 and section 42 hold the towels T in place. Thus, when the sprayer handle 12 is removed and tube 34 unclipped, the towels are freely removed to serve as a ready aid in cleaning up surfaces, e.g., a cabinet, not ordinarily cleaned with the implement, e.g., mop. Thus, the surface area adjacent the floor to be cleaned can be cleaned, e.g., a spilled drink which leaks over the counter top, cabinet surface and onto the floor can be cleaned by one implement and its associated attachments. Since the sleeves 56 can be adjusted longitudinally, slack of the intermediate section 42 can be adjusted to meet a desired diameter of the paper towels T.

Figure 6:
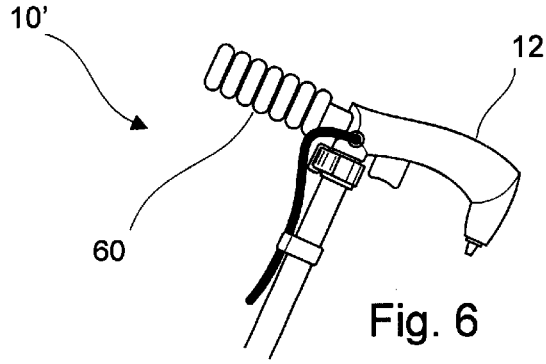
FIG. 6 depicts and ergonomic handle of the invention.

With reference to FIG. 6, the invention 10' depicts a handle end 60 which is configured with some bend relative to the handle 18. This enables the user to apply a force on the cleaning implement 5 in a more useful manner. The end 60 is further characterized to be a bendable extension.

The cleaning implement is therefore rendered a more productive cleaning tool with the addition of the present invention. In accordance with this invention, it has been found that the task of mopping a floor as well as adjacent cabinetry and counter surfaces is quicker and easier. As many variations will be apparent from a reading of the above description, such variations are embodied within the spirit and scope of this invention as defined by the following appended claims.

What is claimed is:

1. A cleaning aid attachment configured for connection to a handle of a conventional cleaning implement, which includes:

a spray handle having a first end adapted to receive an end of the implement handle and having means for retaining the same thereto, a second end of the spray handle including a spray nozzle, an intermediate section connecting said first end and said second end and enabling a hand grip to be made thereon, and a pump trigger operatively connected to said nozzle;

a supply tube having a first end extending into said spray handle which operatively connects to said pump trigger to supply fluid to said nozzle, and a second end of said tube extending outside said spray handle;

a threaded cap receiving said second end of said supply tube therethrough, wherein said cap is configured to thread to a conventional cleaning fluid supply bottle with said second end of said supply tube extending sufficiently therethrough into the bottle fluid when said cap is adapted to be connected to the bottle; and a bottle holder adapted to be connected to the implement handle for holding the bottle.

2. The cleaning aid attachment of claim 1, wherein said spray handle is readily removably connected to the implement handle to provide use of said spray handle in a manner relatively free from the implement handle's end.

3. The cleaning aid attachment of claim 1, wherein said bottle holder is adapted to be removably fixed to the implement handle to provide quick attachment and detachment.

4. The cleaning aid attachment of claim 1, which further includes at least one supply tube clip connectable to the implement handle for retaining an intermediate portion of said supply tube.

5. The cleaning aid attachment of claim 4, which includes two said clips which are longitudinally spaced such that when said supply tube is retained by said clips there is formed a paper towel retaining mechanism.

6. The cleaning aid attachment of claim 1, which further includes means connectable to the implement handle for remaining paper towels and dispensing the same.

7. A cleaning aid attachment configured for connection to a handle of a conventional cleaning implement, which includes:

a removable hand held sprayer adapted to be connected to a handle of a cleaning implement;

means adapted to be slidably frictionally connected to the handle of the cleaning implement for retaining a roll of paper towels having a tube therein, wherein the tube of the towels is adapted to receive the handle and when so received on the handle the retaining means are slid adjacent to ends of the towels in a predetermined position on the implement handle to retain the towels; and wherein said hand held sprayer includes:

a spray handle having a first end configured to receive an end of the implement handle and having means for retaining the same thereto, a second end of the spray handle including a spray nozzle, an intermediate section connecting said first end and said second end and enabling a hand grip to be made thereon, and a pump trigger operatively connected to said nozzle;

a supply tube having a first end extending into said spray handle which operatively connects to said pump trigger to supply fluid to said nozzle, and a second end of said tube extending outside said spray handle; and a threaded cap receiving said second end of said supply tube therethrough, wherein said cap is configured to thread to a conventional cleaning fluid supply bottle with said second end of said supply tube extending sufficiently therethrough into the bottle fluid when said cap is connected to the bottle.

8. The cleaning aid attachment of claim 7, which further includes a bottle holder adapted to be connected to the implement handle for holding the bottle.

9. The cleaning aid attachment of claim 8, wherein said bottle holder is adapted to be removably fixed to the implement handle to provide quick attachment and detachment.

10. The cleaning aid attachment of claim 7, wherein said spray handle is readily removably connected to the implement handle to provide use of said spray handle in a manner relatively free from the implement handle's end.

11. The cleaning aid attachment of claim 7, wherein said retaining means includes at least one supply tube clip connectable to the implement handle for retaining an intermediate portion of said supply tube.

12. The cleaning aid attachment of claim 11, which includes two said clips which are longitudinally spaced such that when said supply tube is retained by said clips there is formed said retaining means.

13. The cleaning aid attachment of claim 1, wherein said first end includes a relatively bendable extension forming an ergonomic handle.

* * * * *